United States Patent [19]

Zatek

[11] Patent Number: 4,550,674

[45] Date of Patent: Nov. 5, 1985

[54] BOAT HULL PLANKING METHOD

[76] Inventor: Kazimierz Zatek, 19 Forest St., So. Weymouth, Mass. 02190

[21] Appl. No.: 637,511

[22] Filed: Aug. 3, 1984

[51] Int. Cl.[4] ..... B63B 5/02

[52] U.S. Cl. ..... 114/358; 114/82

[58] Field of Search ..... 114/82, 84, 86, 358, 114/357, 355; 217/65, 88, 96

[56] References Cited

U.S. PATENT DOCUMENTS 613,693 11/1898 Liddy ..... 114/86

2,163,998 6/1939 Higgins ..... 114/82 X

*Primary Examiner*—Sherman D. Basinger

*Attorney, Agent, or Firm*—John P. McGonagle

[57] ABSTRACT

A new method of hull construction using double, longitudinal, sealed, alternate and prestressed wooden planking. The hull is formed of an inner layer of longitudinally extending planks and an outer layer of longitudinally extending planks alternately positioned over and glued to the inner layer. Both layers are attached to the ribs defining the hull framework. The inner layer planks are abutted and glued along their longitudinal edges. The outer layer planks are beveled along their longitudinal edges forming longitudinal grooves between each plank. Hardwood splines, running the length of the longitudinal grooves are glued and forced into the grooves.

7 Claims, 4 Drawing Figures

BOAT HULL PLANKING METHOD

BACKGROUND OF THE INVENTION

This invention relates to wooden boats and in particular to a new method of hull construction using double, longitudinal, sealed, alternate and prestressed planking.

Traditional hull construction with wooden planking generally uses one of two building methods: single planking or double planking. Single planking is the more commonly used method of the two. In this method a single layer of individual planks are longitudinally placed and bent in a fore and aft direction across the ribs of a boat, the ribs defining the shape of the boat. The planks are fastened to the ribs with various mechanical fasteners such as nails, screws, rivets, etc. The longitudinal edges of the planks abut against each other, and are usually beveled to form a "V" groove seam that opens outboard, i.e., away from the center of the hull. The "V" groove seam is then filled snugly with various types of caulking material such as oakum, cotton, etc., and covered with a flexible seam compound. When the boat is placed in water, the planks swell thereby closing the seams. The caulking material provides watertightness between the planks and flexibility to compensate for expansion.

There are drawbacks with the single planking method. Over time the caulking medium tends to physically deteriorate and move within the seams. In addition, there is alternate shrinking and swelling of the planks as the boat is wetted and dried by the sea and sun, and also as the boat is hauled in and out of the water for storage, maintenance and repairs. The alternate shrinking and swelling cracks the hull sealer coats, i.e., paints and varnishes, which have been applied over the hull. The cracking is especially prevalent at the caulked longitudinal seams. This, plus the deterioration and movement of the caulking material, breaks the watertight integrity of the hull and breaks the caulking-to-wood bond within the seams, thus causing serious leaks. Leakage leads to rotting and weakening of the wooden planks and causes additional deformation by alternately wetting and drying the hull planking which in turn accelerates and compounds the cycle of deterioration. A further drawback with the single planking method, and possibly the most serious, is that the strength of a single planked hull is based on a single layer of wooden planks. Deterioration of the planks leads to direct loss of strength. This is further aggravated by the traditional method of building single plank boats which results in each plank behaving relatively independently under both normal and catastrophic stresses. Mechanical fasteners limit stress dispersal between individual planks and, indeed, often tend to focus stress upon themselves. Stresses, instead of being harmlessly dispersed throughout the entire structure of the hull, tend to remain concentrated at the point where they occur, thus jeopardizing the hull.

The second traditional method of hull construction with wooden planking, double planking, is an attempt to overcome the strength limitations of the single planking method. In this form two layers of alternating, longitudinal wooden planks are fastened to the ribs. Essentially, a hull with two skins is built using two layers of planking, one layer of planking lying directly atop the other. The first or inboard, i.e., toward the center of the hull, layer of planks consists of individual wooden planks longitudinally positioned and bent in a fore and aft direction across the ribs of a boat. The planks are fastened to the ribs with mechanical fasteners as in the single planking method. The longitudinal edges of the planks are not beveled to form a caulking groove, but abut flat to each other, normally with no glue or sealer between them. The second or outboard layer is positioned longitudinally in a fore and aft direction over the first layer. The longitudinal edges of the outboard layer planks are generally aligned over the inboard layer planks so that they are positioned to lie approximately midway between the longitudinal edges of the inboard layer planks. The second layer of planks is then mechanically fastened through the first layer of planks to the ribs. The longitudinal edges of the outboard layer planks are beveled, as in the single planking method, to form a "V" groove seam that opens outboard. The "V" grooves are caulked and sealed as in the single planking method.

The first and second layers of planks in the double planking method are normally separated with a non-adhesive sealer, such as shellac, or with various kinds of rot preventers, such as a membrane of canvas covered with white lead. Neither of these methods prevent water seepage between the two layers of the hull, for many of the same reasons as in the single planking method. Trapped water, plus lack of ventilation, leads to wood rot. Despite its added strength, a double planked hull shares the major imperfections of a single planked hull, with the added problem that inspection for any deterioration between the two layers of planks is impossible without removing the outer planks. Therefore, rot between the inner and outer layers of planks is extremely difficult to locate and repair.

The relative independence and actual movement of each individual, mechanically fastened plank within a single planked or double planked hull is ultimately the major cause of hull deterioration and failure. Various methods have been used to minimize plank movement and independence. Hulls have been reinforced by inlaying into them diagonally running wooden or metal members. The prolific use of metal or wooden knees at critical structural junctures, to transfer stress, triangulate the planking-rib matrix, and tighten corners has also been tried. However, mechanical fastenings and the use of diagonal bracing and knees, address only the symptoms and not the primary problem of traditional wooden plank hull construction: independent, separately working wooden planks.

SUMMARY OF THE INVENTION

The present invention is directed to a method of constructing a boat hull from a plurality of wooden planks. The method in accordance with the present invention is comprised of the steps of: arranging as an interior layer, and attaching to the hull ribs, a plurality of wooden planks with their longitudinal edges glued and abutting in a longitudinally extending fore to aft direction; arranging as an exterior layer and attaching to the hull ribs through the interior layer a plurality of wooden planks with their longitudinal edges beveled to form a groove in a longitudinally extending fore to aft direction; positioning each of the exterior layer planks such that the middle of each exterior plank is intermediately placed over the longitudinal edges of the interior planks; gluing the exterior planks to the interior planks in the arrangement described; placing an adhesive into the grooves formed by the exterior planking; and forcing into said grooves hardwood splines longitudinally extending the length of the grooves.

In the present invention the grain of the wood in both the inner and outer layers of planking runs approximately in the same longitudinal direction. Since the ratio of expansion along wood grain versus perpendicular to wood grain is approximately 10:1, this tends to harmonize contractive and expansive forces in the hull. In cross and diagonally running multi-layer hull planking and in plywood construction, whether adhesives are used or not between the planking layers, the layers of expanding and contracting planks work against each other at similar ratios, creating destructive stresses within the hull. By keeping the direction of the wood grain in each of the two planking layers roughly parallel, as in the present invention, major and minor axes of expansion remain aligned and such conserns are minimized. However, if the wood grains are perfectly aligned, hull splitting along the layers of grain would be a danger. In the present invention, the grain directions of the inner and outer layers of planking are slightly mismatched due to natural irregularities of grain in each plank, and the inner and outer layers of planks are united together with adhesive under pressure. This provides excellent resistance to the hull splitting along the layers of grain.

In the present invention, the traditional drawback of having to repeatedly caulk a single or double planked hull to maintain watertightness is eliminated. By driving with extreme force a hardwood spline into a prepared groove between each outboard plank, absolute wood-to-wood contact between each of the planks of the outer layer is provided. This ensures absolute watertightness, and, because of the spline's wedging action, creates a transverse tension in the outer layer of planking that both prestresses the hull against external forces and provides a uniform, stable, seamless base for the excellent adhesion of exterior sealers.

The splines used in the present invention are made of a wood of higher density and slightly different coefficients of thermal and hydraulic expansion than the wood used for the inner and outer layers of planking. The spline's cross-sectional dimension is small in comparison to the cross-sectional dimension of each plank, and due to the additive property of wood expansion, the splines tend to simulate natural pockets of differing density in the planking wood itself. This minimizes the spline's disruption of the uniform density of the planking in the present invention.

The spline's transverse compressive effect, in concert with the gluing under pressure of all hull components, effectively creates an harmonious monocoque structure. Each side of the hull described by the present invention acts as a compoundly curved laminated beam with the properties of excellent dipersal of thermal, hydraulic, impact and torque stresses. The contribution to hull deformation by the independent, separately working individual planks of a traditionally planked wooden hull is effectively eliminated.

Glues and woods are very different substances, with different coefficients of thermal and hydraulic expansion, different moduli of elasticity, and different chemical properties. All woods are comprised chiefly of roughly parallel water and sap conducting tubules tightly bonded together with natural adhesives. When gluing two pieces of wood together, it is important to simulate the structure of natural wood. The most successful glue joints are obtained when the tubules, or grain, of both glued pieces are aligned parallel to each other and left uncut. Also, the adhesive used in the glue joint must be squeezed under extreme pressure. Pressure not only increases mechanical bonding by forcing adhesive into minute irregularities on the surfaces of the wood, but it also minimizes the amount of foreign material, e.g., adhesive, left in the glue joint.

Each step of the gluing process in the present invention is completed in approximately one-half to one hour, while the adhesive between each spline and its adjacent outer layer plank, and the adhesive between each outer layer plank and its subjacent inner layer planks, is still wet. This allows for micro-slippage of the outer layer plank over its subjacent inner planks as the outer layer plank compresses when its adjacent spline is driven in.

In any monocoque structure it is important to maintain homogenity of material for reasons of unimpeded stress dispersal and harmony of physical parameters, i.e., coefficients of expansion, etc. The structure should not work against itself. The present invention describes a method of wooden hull construction whereby each component of the hull (splines, and inner and outer planks) may be glued together under extreme pressure. This method minimizes the amount of adhesive left in glue joints by providing excellent access for wood clamping mechanisms at each step of hull construction, which thereby insures the benefits of perfect wood-to-wood contact in each glued joint in the hull: unimpeded stress dispersal and harmony of physical parameters.

The normal passage of water through leaking seams in a traditionally planked and caulked wooden hull causes rot, electrolytic and galvanic deterioration of mechanical fasteners, and hydraulic expansion and contraction of the planking. This eventually breaks the caulking-to-wood and sealer-to-wood bonds. The gluing together under pressure of each component of the hull and the use of hardwood splines as described in the present invention, prevents the passage of any water through the hull. Also, because the present invention effectively eliminates working seams in the hull, the passage of liquid water through the sealer coat is prevented.

Modern transparent varnishes, the preferred exterior sealer for hulls produced by the present invention, permit constant visual inspection of the structural components of the hull. Unsightly repairs and fillers necessitated by the deterioration caused by water passing through a traditionally planked hull are obviated by the absolute watertightness of the present invention, thus allowing modern varnishes to be extensively and successfully used. Modern varnishes act as slightly permeable membranes. They are constructed to pass minute amounts of water molecules both into and out of the wood they protect. This slight permeability of modern varnishes tends to average extreme differences between the amount of humudity occuring on both sides of the varnish membrane, allowing hull planks of the present invention to breath and slowly adjust themselves to the particular environment. Hydraulic shock and subsequent failure of the varnish sealer coat of the hull of the present invention is thus avoided.

The technique of the present invention results in a hull of sufficient transverse strength and stiffness that the total cross-section of the ribbing required to brace each individual plank of a traditionally planked wooden hull, or to help maintain the hull shape of a traditionally planked wooden hull, is reduced by one-third to one-half of the rib cross-section traditionally required. In the present invention, the major functions of the hull ribbing are to ensure safety in the unlikely event of catastrophic adhesive failure, and to provide additional transverse bracing between each of the planks of the hull against catastrophic expansive forces occuring within the hull, e.g., the boat being violently swamped by an unexpected wave.

Various advantages and features of novelty which characterize the invention are pointed out with particularity in the claims annexed hereto and forming a part hereof. However, for a better understanding of the invention, its advantages, and objects obtained by its use, reference should be had to the drawings, which form a further part hereof, and to the accompanying descriptive matter, in which there is illustrated and described a preferred embodiment of the invention.

DESCRIPTION OF THE PREFERRED EMBODIMENT

Figure 1:
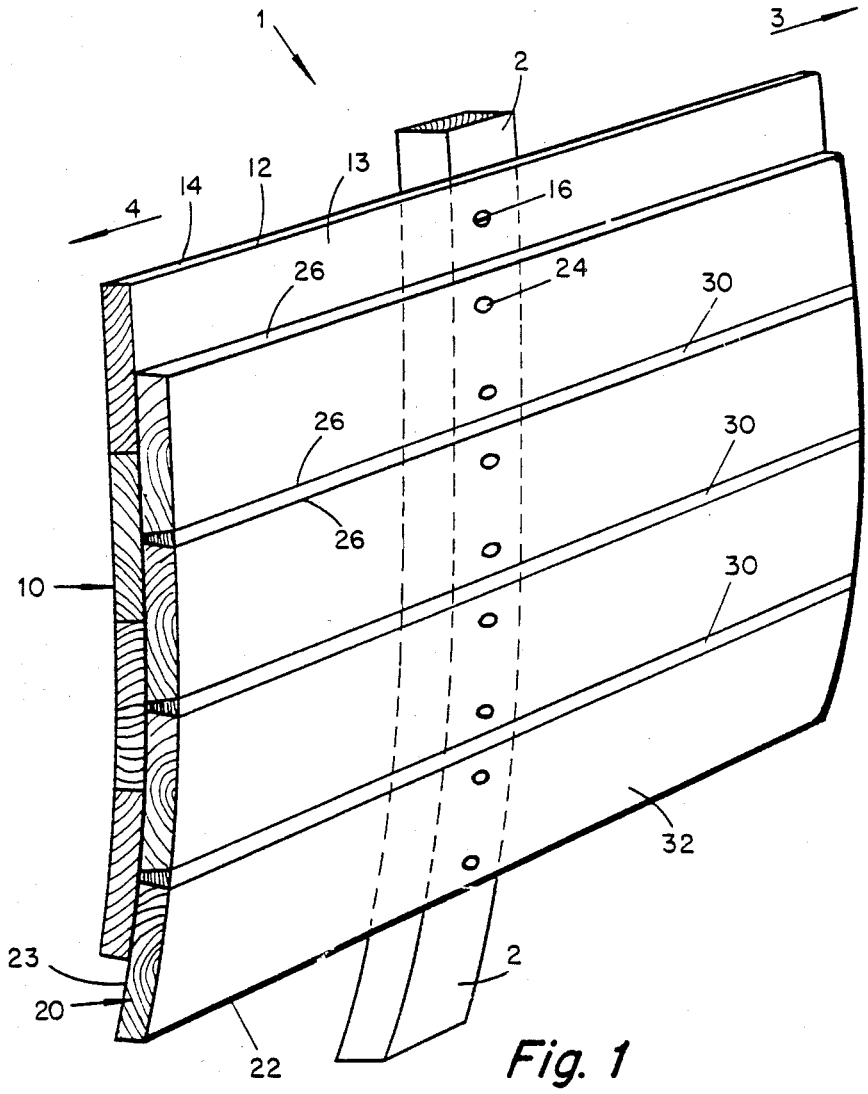
FIG. 1 is a perspective view of a section of a boat hull constructed in accordance with the present invention.
Figure 2:
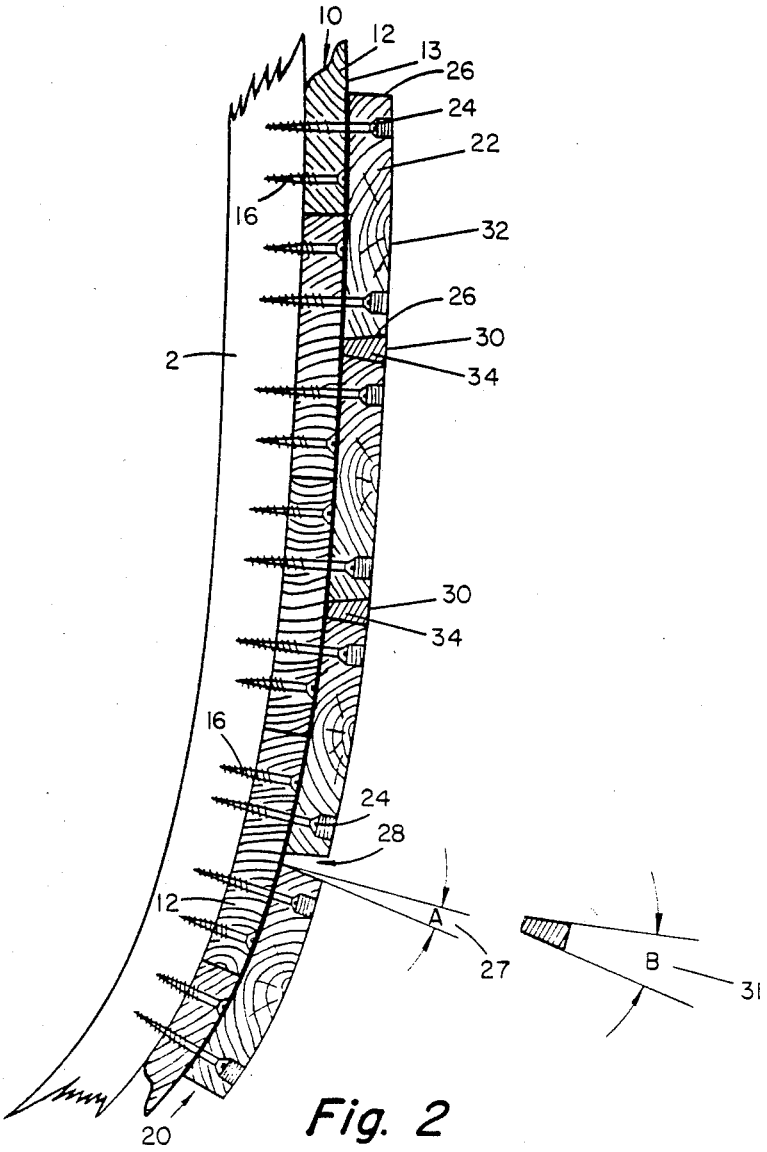
FIG. 2 is a vertical cross-sectional view of the hull section shown in FIG. 1.

Referring to the drawings in detail, wherein like numerals indicate like elements, there is shown in FIG. 1 a section of boat hull constructed in accordance with the present invention designated generally at 1. FIG. 2 is a vertical cross-sectional view of the hull section shown in FIG. 1. The hull 1 is made up of ribs 2, an inner planking layer 10, and and outer planking layer 20.

The inner layer 10 is comprised of a plurality of wooden planks 12 positioned perpendicular to the ribs 2 and longitudinally extending in a fore 3 to aft 4 direction. The planks 12 are arranged with adjacent longitudinal edges 14 abutting one another and are attached to the ribs 2 with mechanical fasteners 16 such as screws or rivets.

The outer layer 20 is also comprised of a plurality of wooden planks 22 positioned perpendicular to the ribs 2 and longitudinally extending in a fore 3 to aft 4 direction. The planks 22 are arranged so that they overlap the longitudinal edges 14 of the inner planks 12. The outer planks 22 are intermediately positioned over the edges 14 of the inner planks 12 such that the middle of each exterior plank 22 is intermediately placed over the longitudinal edges 14 of the interior planks 12. The planks 22 are attached to the ribs 2 through the inner layer 10 by means of fasteners 24 such as screws or rivets. The outer planks 22 are beveled at approximately $5\frac{1}{2}°$ along their longitudinal edges 26 and arranged along side each other so that a groove 28 extending longitudinally in a fore 3 to aft 4 direction is formed between each plank 22. Into this groove 28 an adhesive and a continuous, longitudinal spline 30, of the same thickness as the outer planks 22 but slightly wider than the groove 28, having a trapezoidal cross-section and made of a hard wood, is forced into the groove 28 until flush with the outer surface 32 of the outer planking 22.

Figure 3:
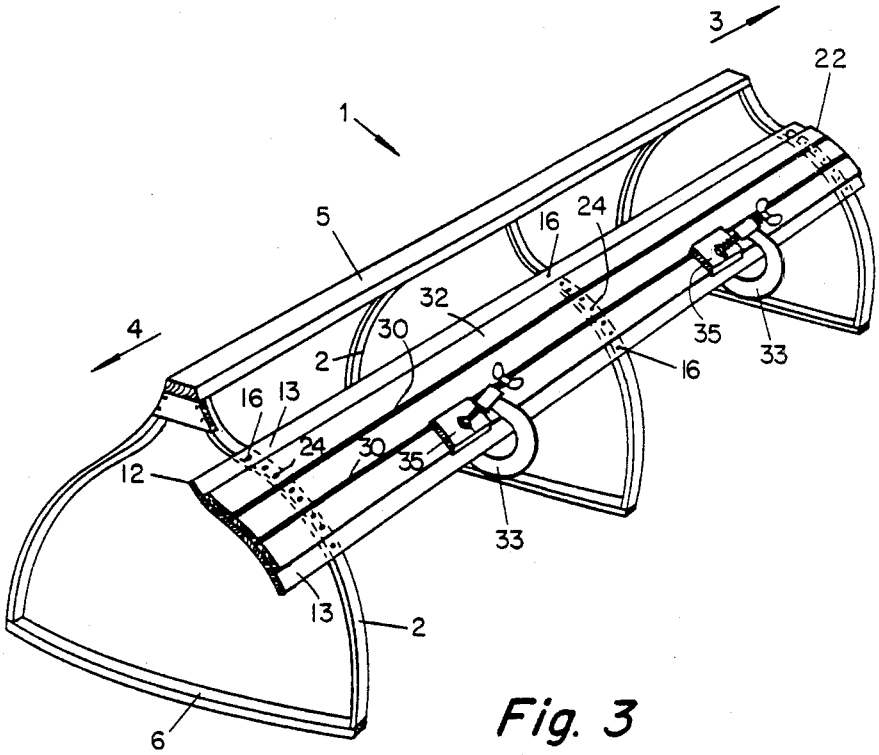
FIG. 3 is a perspective view of a section of a boat hull partially constructed in accordance with the present invention.

FIG. 3 is a perspective view of a section of a boat hull partially constructed in accordance with the present invention and is illustrative of the method of construction in accordance with the present invention. The boat hull is bottom side up, with the keel 5, or base of the boat, at the top. The ribs 2 are braced 6 during construction. Both planking layers 10 and 20 are constructed at the same time with the inside layer 10 always one-half a plank 12 ahead. The interior planks 12 are arranged longitudinally in a fore 3 to aft 4 direction with longitudinal edges 14 abutting. The edges 14 are spread with glue and the planks 12 are fastened to the ribs 2 with mechanical fasteners 16. After the first two inner planks 12 are edge-glued with a standard waterproof epoxy, positioned and fastened, the inner plank 12 outboard surfaces 13 are covered with the same epoxy. An outer plank's 22 inboard surface 23 is spread with glue. The plank 22 is then positioned and laid longitudinally over the inner planks 12 so that the seam formed by the inner planks' 12 longitudinal edges 14 is overlapped by the outer plank 22. The outer plank 22 is attached through the inner planks 12 to the ribs 2 with mechanical fasteners 24 such as screws or rivets. The outer planks 22 and inner planks 12 are clamped together using clamping blocks 35 preshaped to the relevant contour of the hull 1 and held by clamps 33 to ensure uniform and complete wood-to-wood contact between the inner planking layer 10 and the outer planking layer 20. The epoxy adhesives are then allowed to set and harden usually from four to eight hours.

Figure 4:
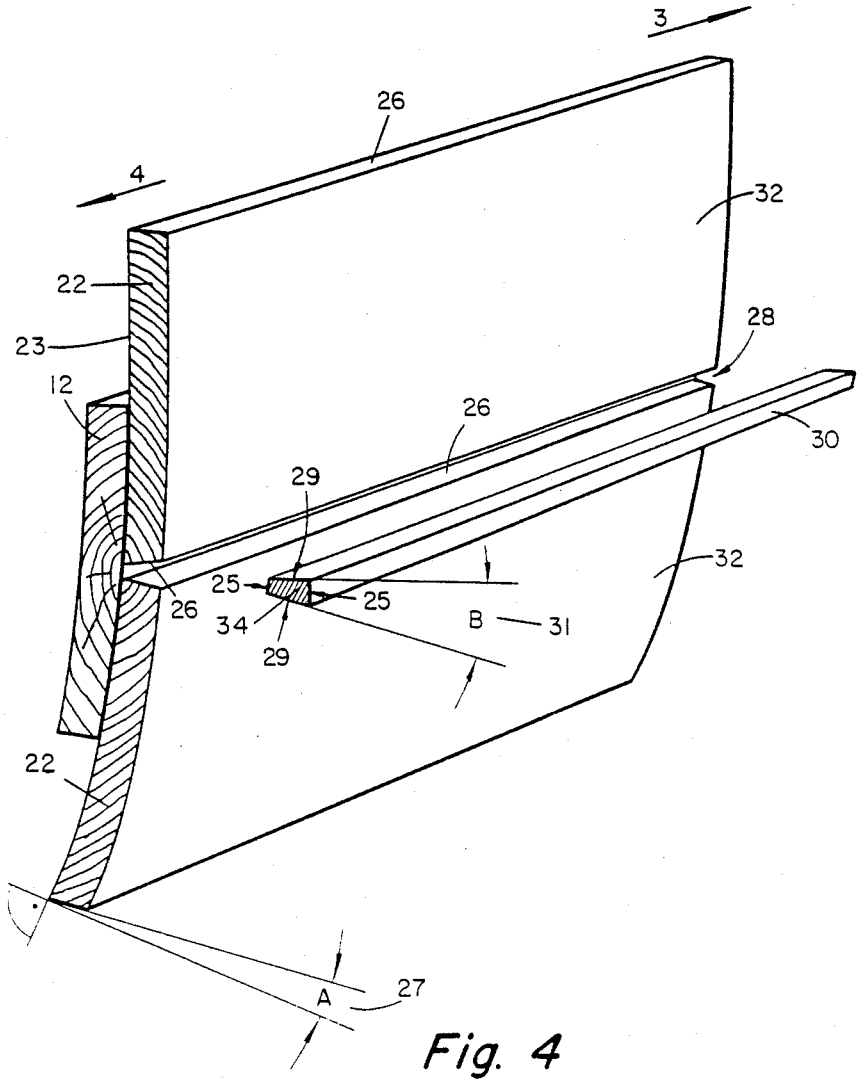
FIG. 4 is an enlarged perspective view of the section of boat hull shown in FIG. 1 with spline removed.

FIG. 4 is an enlarged perspective view of the section of boat hull shown in FIG. 1. It has the spline 30 removed. From this figure it can be seen that the longitudinal edges 26 of the outer planks 22 are beveled. "A" 27 represents the angle of the bevel and, in this embodiment of the invention, is set at $5\frac{1}{2}°$. As can be seen in this figure and FIG. 3, the outer planks 22 are further positioned so that their beveled edges 26 form a longitudinal groove 28 extending the length of the hull 1 in a fore 3 to aft 4 direction. A spline 30, which in this embodiment of the invention has a regular trapezoidal cross-section 34, the non-parallel sides of which form an angle "B" 31 focusing at 11°, made of wood slightly harder than that of the outer planks 22, having a width 29 slightly greater than the groove 28, having a thickness 25 the same as that of the outboard planks 22, and extending the length of the hull 1, is covered with glue and forced into the groove 28 under pressure until it is flush with the outer surface 32 of the outer planks 22. The imbedded spline 30, inner planks 12 and outer planks 22 are then heavily clamped together using a maximum number of clamping blocks 35 preshaped to the relevant contour of the hull 1 and held by clamps 33, and left until the epoxy sets and hardens. This process is repeated until the entire hull is constructed.

Since the spline 30 is made of a wood harder than the outer planks 22, some compression of the outer planks 22 occurs. This prestresses the planks 22 in the outer layer 20 and provides greatly increased stiffness to the entire hull 1. When construction is complete, a sealer is applied over the hull 1.

It is understood that the above-described embodiment is merely illustrative of the application. Other embodiments may be readily devised by those skilled in the art which will embody the principles of the invention and fall within the spirit and scope thereof.

I claim:

1. A method of constructing a wooden boat hull with fore and aft ends and containing ribs defining its framework, comprising the steps of:

arranging as an interior layer a plurality of wooden planks with outside and inside faces, and longitudinal edges in a longitudinally extending fore to aft direction, perpendicular to and outside the hull ribs;

applying glue to the longitudinal edges of the planks of the interior layer;

abutting the longitudinal edges of the planks of the interior layer;

attaching the planks of the interior layer to the hull so that the inside faces of the planks are positioned against the hull ribs;

applying glue to the outside faces of the planks of the interior layer;

arranging as an exterior layer a plurality of wooden planks with outside and inside faces and beveled longitudinal edges in a longitudinally extending fore to aft direction perpendicular to the hull ribs and positioned such that the inside faces of the planks adjoin the outside faces of the planks of the interior layer;

applying glue to the inside faces of the planks of the exterior layer;

positioning the planks of the exterior layer so that the middle of the inside face of each is intermediately placed over the abutted longitudinal edges of the planks of the interior layer;

positioning further the planks of the exterior layer so that their beveled edges form a longitudinal groove extending the length of the hull in a fore to aft direction;

attaching the planks of the exterior layer through the interior layer to the hull ribs;

applying glue to the longitudinal grooves formed by the beveled edges of the planks of the exterior layer;

forcing longitudinal splines with a width slightly greater than the width of the longitudinal grooves into said grooves so that the splines are flush with the outside faces of the planks of the exterior layer;

clamping the splines, interior and exterior planks until the glue sets and hardens;

repeating the above steps until the entire hull is covered with an interior layer of wooden planks and an exterior layer of planks with splines forced into the grooves formed by the longitudinal edges of the planks of the exterior layer; and applying a sealer over the completed hull.

2. A method of constructing a wooden boat hull with fore and aft ends and containing ribs defining its framework, as recited in claim 1 wherein:

the longitudinal edges of the planks of the exterior layer are beveled to a five and one-half degree angle.

3. A method of constructing a wooden boat hull with fore and aft ends and containing ribs defining its framework, as recited in claim 2 wherein:

the splines are made of wood.

4. A method of constructing a wooden boat hull with fore and aft ends and containing ribs defining its framework, as recited in claim 3 wherein:

the splines are made of a wood harder than that of the planks of the exterior layer.

5. A method of constructing a wooden boat hull with fore and aft ends and containing ribs defining its framework, as recited in claim 4 wherein:

the splines have a regular trapezoidal cross-section, the non-parallel sides of which form an angle focusing at eleven degrees, a thickness the same as that of the planks of the outer layer, and extend the length of the hull.

6. A method of constructing a wooden boat hull with fore and aft ends and containing ribs defining its framework, as recited in claim 5 wherein:

the glues used are comprised of a waterproof epoxy material.

7. A method of constructing a wooden boat hull with fore and aft ends and containing ribs defining its framework, comprising the steps of:

arranging as a first plank of an interior layer of planks one wooden plank with outside and inside faces and longitudinal edges in a longitudinally extending fore to aft direction, perpendicular to and outside the hull ribs;

attaching the first plank of the interior layer to the hull ribs with mechanical fasteners so that the inside face of the plank is positioned against the hull ribs;

arranging as a second plank of the interior layer of planks a wooden plank parallel to and adjacent to the first plank of the interior layer and positioned against the hull ribs;

applying glue to the adjacent longitudinal edges of the first and second planks of the interior layer;

abutting the adjacent longitudinal edges of the first and second planks of the interior layer;

attaching the second plank of the interior layer to the ribs with mechanical fasteners so that the inside face of the second plank is positioned against the hull ribs;

arranging as a first plank of an exterior layer of planks a single wooden plank with outside and inside faces and longitudinal edges each beveled to five and one-half degrees, extending in a fore to aft direction perpendicular to and outside of the hull ribs;

applying glue to the outside faces of the first and second planks of the interior layer;

applying glue to the inside face of the first plank of the exterior layer;

positioning the first plank of the exterior layer to symmetrically overlap the longitudinal seam formed by the abutting edges of the first two planks of the interior layer;

attaching the first plank of the exterior layer to the hull ribs by mechanical fasteners through the first two planks of the interior layer;

clamping together both interior and exterior layers of planks using a plurality of clamps and clamping blocks each preshaped to the relevant framework of the hull;

allowing the glue to set and harden;

arranging a third plank of the interior layer similar to the first and second planks of the interior layer;

applying glue to the adjacent longitudinal edges of the second and third planks of the interior layer;

abutting the adjacent longitudinal edges of the second and third planks of the interior layer;

attaching the third plank of the interior layer to the hull ribs with mechanical fasteners;

arranging a second plank of the exterior layer similar to the first plank of the exterior layer;

applying glue to the outside faces of the second and third planks of the interior layer;

applying glue to the inside face of the second plank of the exterior layer;

placing the second plank of the exterior layer to symetrically overlap the longitudinal seam formed by the longitudinal edges of the second and third planks of the interior layer;

forming a longitudinal groove between the adjacent longitudinal edges of the first and second planks of the exterior layer;

attaching the second plank of the exterior layer to the hull ribs by mechanical fasteners through the second and third planks of the interior layer;

applying glue to the groove formed between the longitudinal edges of the first and second planks of the exterior layer;

applying glue to a wooden spline with a width slightly greater than the groove, with a regular trapezoidal cross-section, the non-parallel sides of which focus at eleven degrees, with a thickness equal to the thickness of the planks of the exterior layer, with a hardness greater than that of the planks of the exterior layer, and with a longitudinal length equal to that of the groove;

placing the spline, narrow side first, into the groove formed between the longitudinal edges of the first and second planks of the exterior layer;

forcing the spline into the groove until it is flush with the outer faces of the adjacent planks of the exterior layer;

clamping together the spline and second plank of the exterior layer with the subjacent second and third planks of the interior layer using clamps and clamping blocks preshaped to the relevant framework of the hull;

allowing the glue to set and harden; and repeating the above steps until both sides of the hull are constructed.

* * * * *